United States Patent [19]

Ibsen

[11] Patent Number: 4,467,878

[45] Date of Patent: Aug. 28, 1984

[54] SHAPED CHARGE AND CARRIER ASSEMBLY THEREFOR

[76] Inventor: Barrie G. Ibsen, P.O. Box 1324, Cut Bank, Mont. 59427

[21] Appl. No.: 299,479

[22] Filed: Sep. 4, 1981

[51] Int. Cl.[3] ..... E21B 43/116

[52] U.S. Cl. ..... 175/4.6; 175/4.59

[58] Field of Search ..... 175/4.6, 4.53–4.59; 166/63; 102/312, 313, 319, 320, 331

[56] References Cited

U.S. PATENT DOCUMENTS

| | | | |
|---|---|---|---|
| 2,889,774 | 6/1959 | Allen | 175/4.59 |
| 3,048,101 | 8/1962 | Lebourg | 175/4.6 |
| 4,191,265 | 3/1980 | Bosse-Platiere | 175/4.6 X |
| 4,220,687 | 9/1980 | Christopher | 175/4.6 X |
| 4,253,523 | 3/1981 | Ibsen | 175/4.6 X |
| 4,312,273 | 1/1982 | Camp | 175/4.6 X |
| 4,326,462 | 4/1982 | Garcia et al. | 175/4.6 X |

*Primary Examiner*—Ernest R. Purser
*Assistant Examiner*—Thuy M. Bui
*Attorney, Agent, or Firm*—John E. Reilly

[57] ABSTRACT

In a perforating apparatus, a series of explosive charges are mounted on a frangible strap which is pressfit within a frangible carrier which is suspended from a conventional form of wire line tool in such a way that when the charges are detonated the carrier assembly will be completely disintegrated and the wire line tool can be retrieved for subsequent reuse.

13 Claims, 8 Drawing Figures

SHAPED CHARGE AND CARRIER ASSEMBLY THEREFOR

This invention relates to novel and improved perforating methods and apparatus and more particularly relates to a new and improved perforating apparatus employing shaped charges in a frangible carrier assembly suspended from a wire line tool.

BACKGROUND AND FIELD OF THE INVENTION

It is customary procedure to employ a plurality of shaped charges in perforating subsurface formations, such as, for example, in well bore completion operations. Typically, each charge is made up of a casing which contains explosive material of predetermined configuration and is recessed to receive a conical liner within the casing. When the explosive material is detonated, the liner is propelled with a high degree of force through the carrier wall, outer casing string and cement into the subsurface formation so as to open up the formation for flow of fluid upwardly through the casing string. In the past, the approach has been generally to fabricate the carrier assembly for the explosive material of a reusable material so that following detonation, the carrier can be retrieved. This has presented certain problems in that the construction of the carrier assembly must be such that it is capable of withstanding the explosive force of one or more charges which necessarily are directed through the wall of the carrier; also, expendable portions of the carrier through which the liner of a charge passes often tend to partially disengage from the carrier upon detonation and interfere with the retrieval of the carrier from the casing string.

In copending application for patent, Ser. No. 23,657, filed Mar. 26, 1979 entitled METHOD AND APPARATUS FOR WELL PERFORATION AND FRACTURING OPERATIONS, the foregoing and other problems are alluded to in the construction of a novel shaped charge device intended for perforating and stimulating wells. However, said application has to do more with the definite penetration of the charge into the formation surrounding the well bore as well as the construction and arrangement of various assemblies for use with the various explosive charges as disclosed therein. However, the present invention is concerned more with the construction of the carrier assembly for conventional shaped charges and specifically a way of permitting use of higher capacity charges for given size carriers while avoiding the problem of objectionable interference with the efficient retrieval of the carrier from the casing string.

SUMMARY OF THE INVENTION

It is therefore an object of the present invention to provide for a novel and improved perforating apparatus by which objectionable interference with efficient retrieval of the perforating apparatus from the well casing is avoided.

Another object of the present invention is to provide in a well perforating apparatus for a novel and improved carrier assembly which is capable of undergoing complete disintegration so as not to interfere with the recovery of oil and gas through the well bore.

A further object of the present invention is to provide for a novel and improved mounting and assembly of shaped charges in an expendible carrier and in predetermined orientation such that a blasting cord can be assembled with the charges to undergo detonation for optimum depth of penetration of the charges into a subsurface formation.

It is an additional object of the present invention to provide for a well perforating apparatus in which the capacity of explosive charges employed can be substantially increased for a given size of well casing; and further wherein an expendable carrier is employed which is characterized by its simplicity and ruggedness of construction requiring a minimum number of parts which can be readily assembled to provide a highly efficient perforating apparatus.

In accordance with the present invention, a preferred form of jet perforating apparatus incorporates a plurality of shaped charges, each contained within a flexible enclosure or casing, the casing being so configured as to facilitate ready insertion of the charges in predetermined spaced relation along the length of an elongated strap. A series of charges are assembled on the strap to extend in a direction transversely of the length of the strap, and a blasting cord is threaded through the ends of the casing for the charges so as to be in communication with the explosive material contained therein. The assembled charges and strap are inserted into a carrier, and the ends of the carrier are sealed off by end caps. The upper end cap has an aperture for upward extension of the blasting cord into a conventional form of wire line assembly, and the upper end cap is also fixed by means of a rod to the lower end of the wire line assembly. The carrier, end caps and strap are composed of thin-walled frangible materials such that they will completely disintegrate upon explosion. Further, the reduced wall thickness of the carrier will permit use of increased explosive capacity in each charge for a given internal diameter of the carrier. Here, the wall thickness of the carrier is uniformly reduced throughout by virtue of the absence of any special slots or grooves for mounting or retention either of the explosive charges or blasting cord.

The above and other objects, advantages and features of the present invention will become more readily appreciated and understood from the foregoing detailed description of a preferred embodiment when taken together with the accompanying drawings, in which:

DETAILED DESCRIPTION OF THE PREFERRED EMBODIMENT

Figure 1:
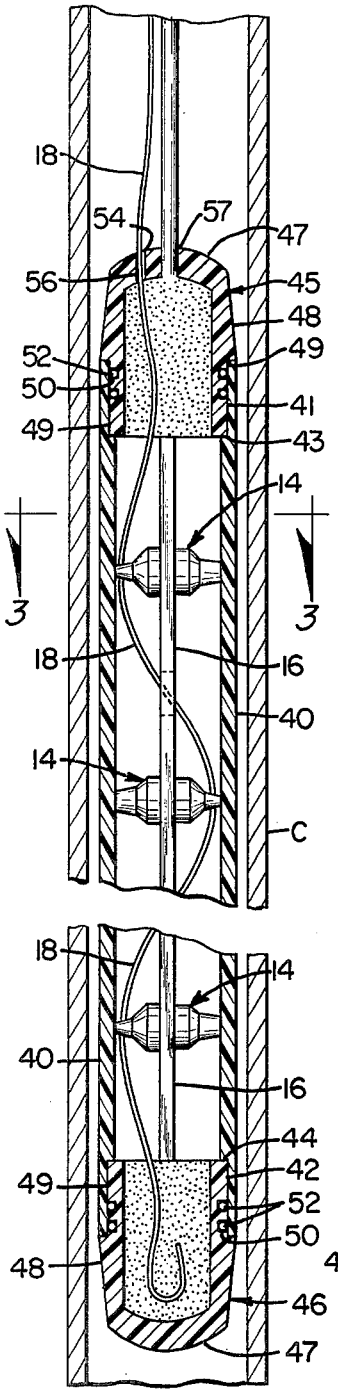
FIG. 1 is a longitudinal cross-sectional view of a preferred form of jet perforating apparatus suspended in a well bore.
Figure 2:
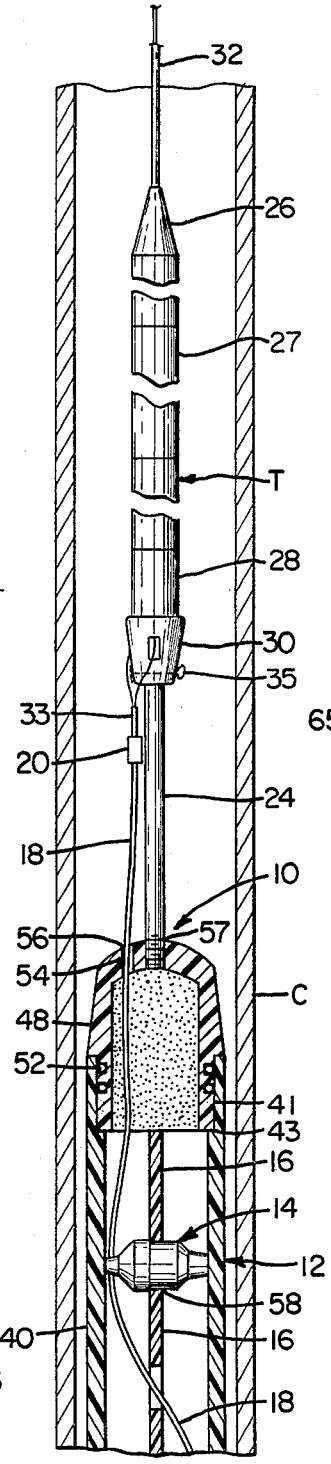
FIG. 2 is another cross-sectional view of the upper end of the perforating apparatus and specifically illustrating the preferred manner of interconnection between the preferred form of carrier assembly and wire line.

Referring in detail to the drawings, there is illustrated in FIG. 1 the preferred embodiment of perforating apparatus 10 suspended in a casing string C at the lower end of a well bore. As shown in FIGS. 1 to 4, the apparatus 10 is broadly comprised of a carrier assembly 12 which is formed of a plurality of explosive charges 14 mounted on an elongated strap 16, and a blasting cord 18 extends downwardly through the carrier assembly 12 for connection to an end of each charge 14. The upper end of the blasting cord 18 is connected to a blasting cap 20 at the lower end of a wire line tool T, the latter being connected to the upper end of the carrier assembly by a threaded rod 24.

As a setting for the present invention, reference is made to the preferred manner of suspension of the carrier assembly 12 from a conventional wire line tool T. Here, it is desirable that the carrier assembly be suspended from the tool T in such a manner that the tool can be retrieved and reused following detonation of the explosive charges 14 and destruction of the carrier assembly. Thus, the tool T establishes a means of suspension of the carrier assembly for extended distances downhole while providing the necessary means of energization of the primer cord or blasting cord 18 in the detonation of the charges 14. For this purpose, the tool T may be suitably comprised of a tapered cable end 26 to which is secured a sinker bar 27 and magnetic collar locator 28 which in turn is connected to a shooting head adaptor 30 at its lower end. The wire line tool is suspended from a cable 32 containing wire conductors 33 which pass downwardly through the interior of the tapered cable end 26 and through the entire length of the tool then project outwardly from the shooting head adaptor 30. The wire conductors 33 are connected to the blasting cap 20, and the blasting cap 20 is connected as previously described to the upper end of the blasting cord 18. The carrier assembly 12 is suspended from the wire line tool by means of the threaded rod 24 which is releasably connected to the lower end of the adaptor 30, for example, by releasable fasteners in the form of a cotter pin 35.

An important feature of the present invention resides in the construction and arrangement of the carrier assembly 12 and the manner of suspension and mounting of the explosive charges 14 within the carrier assembly. Preferably, the carrier assembly 12 is comprised of an elongated, hollow, generally cylindrical housing or tubular portion 40 which is of uniform wall thickness except at its ends which are counterbored or otherwise increased in diameter slightly to form enlarged inner wall surfaces 41 and 42, each end terminating in a shoulder 43 and 44 at its intersection with the reduced diameter of the inner wall surface of the tubular portion 40. The opposite ends are adapted for insertion of the leading ends of upper and lower end caps 45 and 46, respectively. Each of the end caps 45 and 46 is similarly of generally cup-shaped configuration having a rounded end or nose 47 and forwardly projecting, generally cylindrical wall 48 terminating in a reduced leading end 49; i.e., the leading end 49 has a reduced external diameter corresponding to the internal diameter of the opposite ends 41 and 42 such that the external surfaces of the forwardly projecting walls 48 are flush with the external surface of the tubular portion 40. Annular grooves 50 are formed in the external surfaces of the leading ends 49 of the end caps for the purpose of receiving O-rings 52, there being preferably a pair of O-rings 52 mounted in axially spaced relation on the leading end of each cap 41 and 42 so as to establish a firm pressfit or interference fit between the end caps and opposite ends of the tubular portion. This may be aided by the application of a bonding agent, such as an epoxy, between the mating surfaces of the leading ends of the end caps and the opposite ends of the tubular portion. It will therefore be appreciated that the end caps are similarly constructed so as to effect a sealed connection at opposite ends of the tubular portion; however, the upper end cap 41 is provided with an aperture 54 passing through the nose 47 to permit insertion of the blasting cord 18. A Neoprene seal designated at 56 is interpositioned between the blasting cord and wall of the aperture 54 so as to effect a seal around the opening. The lower threaded end of the rod 24 is inserted into a threaded opening 57 in the upper end cap 41 and most desirably the threaded opening extends less than the full thickness of the nose 47.

As a preliminary to the assembly of the end caps 41 and 42 at opposite ends of the tube 40, the explosive charges 14 are suspended in the carrier assembly 12 on the elongated strap 16. In the preferred form, the elongated strap 16 is of generally rectangular configuration and is given a length just less than that of the length of the tube 40. The strap most desirably corresponds to the length of the tube 40 between the shoulders 43 and 44, and is of a width corresponding to the inner diameter of the tube 40 so that it can be inserted lengthwise in snug-fitting relation to the inner wall of the tube 40. The strap is provided with a series of charge-receiving openings 58 which correspond in configuration to the cross-sectional configuration of the charges 14. Thus, in the preferred form, the openings 58 are of generally circular configuration and are arranged at equally spaced intervals along the length of the strap intermediately between opposite side edges. Both the strap and the tubular portion 40 as well as the end caps 45 and 46 are composed of a frangible material which is capable of withstanding any high pressures encountered in downhole operations; yet, will completely disintegrate when the charges are detonated and exploded. For this purpose, the materials employed in the fabrication of the carrier assembly consisting of the strap, tubular portion and end caps are made up of on the order of 82 parts by weight of polystyrene and 18 parts by weight calcium carbonate, although these proportions may be suitably varied according to the size of the carrier assembly and desired wall thickness for a given charge or number of charges.

Figure 3:
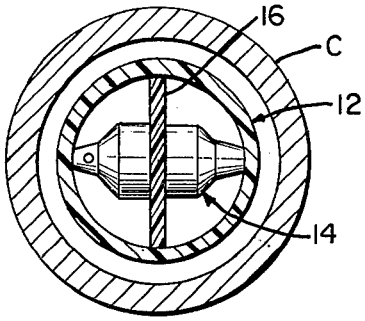
FIG. 3 is another cross-sectional view of the preferred form of perforating apparatus.
Figure 4:
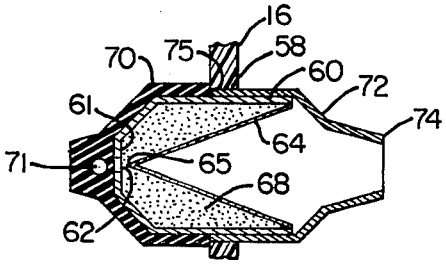
FIG. 4 is a cross-sectional view through one of the explosive charges as illustrated in FIGS. 1 to 3.

A typical charge employed in jet perforating operations is illustrated in detail in FIGS. 3 and 4 and is seen to comprise a generally cylindrical steel jacket 60 having a closed end 61 provided with a bore 62 extending through the closed end 61. A generally conical shaped copper liner 64 is inserted into the open end of the jacket 60 with its apex 65 extending in a direction toward the bore 62 and an explosive material or combination of explosive materials is contained as at 68 between the conical liner 64 and jacket 60. The assembled charge is housed within a resilient casing which may actually be made in two halves consisting of a relatively thick-walled casing half 70 which houses the major portion of the jacket 60 and surrounds the closed end 61 of the jacket with an opening 71 extending through one end of the casing normal to and in communication with the bore 62. This bore 71 is adapted for insertion of the blasting cord therethrough. A second casing half 72 is relatively thin-walled and again is composed of a resilient material which tapers away from surrounding relation to the open end of the jacket 60 and into a reduced end portion 74. The thin-walled casing half 72 is joined to the thick-walled casing half 70 by any suitable bonding agent and, at the mating edges of the casing half, it will be seen that the thick-walled casing 70 forms somewhat of a lip 75 which is just greater than the size of the charge-receiving opening 58 in the strap 16. Thus, the thin-walled casing half 72 may be inserted through the opening until the lip 75 of the casing half 70 moves into abutting relation with the surrounding edge of each charge-receiving opening whereby to retain the casing and complete charge assembly in place with its length in perpendicular relation to the length of the strap 16. The overall length of the casing for the charge corresponds to the diameter of the inner wall of the tubular portion 40 so as to cooperate with the strap in maintaining a snug-fitting relationship between the charges and tubular portion 40 of the carrier assembly. The charges are, as stated earlier, preassembled on the strap such that each successive charge projects or extends in an opposite direction from the strap, and the blasting cord 18 is threaded downwardly through the opening 71 in the charges as well as through limited openings 78 which are positioned at spaced intervals along the length of the strap intermediately between the charge-receiving openings 58. The lower extremity of the blasting cord as designated at 18' is merely suspended within the hollow interior of the lower end cap 46 when the end caps 45 and 46 are assembled onto the ends of the tubular portion 40.

By virtue of the pressfit relationship established between the casings, strap and inner wall of the tubular portion 40, it is possible to eliminate internal slots or positioning members for the charges. This relationship, coupled with the frangible composition of the carrier assembly and straps, has been found to permit utilization of higher capacity charges for a given sized carrier assembly, if desired. For instance, it has been found possible to employ a 4" carrier gun charge (22–22.7 grams) inside a 3⅝" diameter carrier in place of the commercially available 3⅛" or 3⅞" ½" carriers which utilize 10 to 14 gram charges. In actual practice, the threaded aluminum rod 24 is generally supplied or made up in sections and is of a length to isolate the wire line tool T from any possible damage when the charges are detonated and exploded. Generally, the explosion will cause the rod to be severed directly above its connection into the carrier assembly so that fragments of the rod may be left in the hole along with the disintegrated carrier assembly; however, the remainder of the rod and the entire wire line tool T may be completely retrieved following each operation. The aluminum rod section 24 may then be replaced and secured to another carrier assembly in preparation for the next perforating operation.

Figure 5:
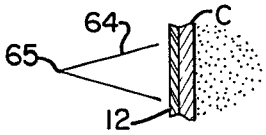
FIGS. 5 through 8 are schematic illustrations of the inversion and propulsion of the conical liner from the explosive charge as it undergoes successive stages of its penetration into the formation.
Figure 6:
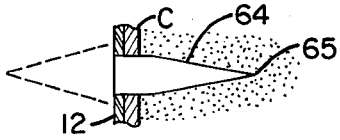
Figure 7:
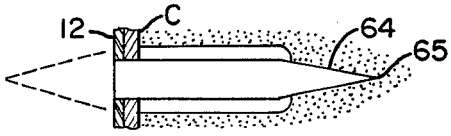
Figure 8:
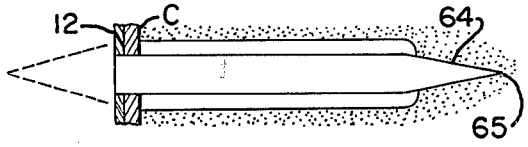

It will recognized that other materials may be employed in fabrication of the carrier assembly which will lend the desired strength for suspension of a series of charges downhole yet will completely disintegrate upon detonation of the charges. In particular, the thermoplastics exhibit the requisite characteristics in combination with a minor proportion of a carrier, such as, calcium carbonate, to increase its specific gravity. When the blasting cap is set off, it will activate the blasting cord 18 to initiate a series of explosions proceeding in succession downwardly through the carrier assembly as each charge in succession is detonated by the blasting cord. As illustrated in FIGS. 5 to 8, the conical liner will undergo an inversion when the charge is set off so that the apex or pointed end 65 of the liner will be discharged through the wall of the carrier 40 and through the casing into the formation, as illustrated in FIGS. 5 and 6. As it proceeds outwardly into the formation as illustrated in successive stages in FIGS. 7 and 8, it will form a cavity or break in the formation so as to encourage the flow of fluid from the formation through the port formed in the casing and into the well bore. The composition of the carrier assembly and strap is such that it will completely disintegrate and collect in the well bore below the openings or ports formed in the casing so as not to interfere with or obstruct the flow of fluid into the interior of the casing from which it an be drawn upwardly for recovery. In this relation, the thin-walled construction of the carrier assembly and its frangible composition is such that it is not necessary to preform openings or sections of weakness in the wall for discharge of the liner upon detonation.

It is therefore to be understood that various modifications and changes may be made in the construction and arrangement of parts as well as the composition of materials comprising the present invention without departing from the spirit and scope thereof as defined by the appended claims.

I claim:

1. A perforating apparatus adapted for use in a cased well bore comprising:

a hollow carrier having an elongated, solid tubular portion provided with an inner wall surface, and opposite end caps disposed in sealed relation to opposite ends of said tubular portion;

a charge-mounting, unitary strap inserted in said carrier, said strap being of elongated, generally rectangular configuration and of a width substantially corresponding to the internal diameter of said tubular portion and provided with spaced openings substantially along its length, each for insertion of a charge therein, said strap dimensioned for snug-fitting insertion into said carrier;

a plurality of explosive charges each having an outer casing of a length substantially corresponding to the internal diameter of said tubular portion, said casing comprising a thin-walled casing portion inserted into one of said openings, said strap and said charges arranged in mutually perpendicular relation to one another and disposed in close-fitting engagement to said inner wall surface of said tubular portion, one end of said casing for each charge provided with an opening for insertion of said blasting chord therethrough; and a blasting cord extending through said carrier and connected to said charges for detonation thereof, said carrier being composed of a frangible material capable of being disintegrated upon detonation of said charges.

2. A perforating apparatus according to claim 1, said carrier being of substantially uniform wall thickness throughout and said strap provided with spaced openings for insertion of said blasting cord therethrough.

3. A perforating apparatus according to claim 1, said elongated strap being composed of a frangible material and being substantially rigid to support said charges in spaced relation to one another, and said casing halves for each charge composed of a resilient material.

4. A perforating apparatus according to claim 1, said opposite end caps hermetically sealed to opposite ends of said tubular portion, and opposite ends of each said charge disposed in snug-fitting relation to diametrically opposed inner wall surfaces of said tubular portion.

5. A perforating apparatus according to claim 4, including O-rings interpositioned between said opposite end caps and opposite ends of said tubular portion, and said blasting cord extending through an opening in one of said end caps.

6. A perforating apparatus according to claim 1, said carrier suspended from a wire line tool, said wire line tool including an elongated rod interconnecting said wire line tool and the upper end of said carrier.

7. A perforating apparatus according to claim 6, said rod including a threaded end insertable into an opening in the upper end cap of said carrier.

8. A perforating apparatus according to claim 1, said carrier being composed of a frangible material consisting of 82 parts by weight of a polystyrene and 18 parts by weight of calcium carbonate.

9. In perforating apparatus adapted for use in a cased well bore, the improvement comprising:

a hollow frangible carrier having an elongated, solid tubular portion of uniform wall thickness throughout, and opposite end caps disposed in sealed relation to opposite ends of said tubular portion;

a rigid, elongated charge-mounting strap inserted in said carrier, said strap being of generally rectangular configuration and of a width corresponding to the internal diameter of said tubular portion and of a length corresponding to the length of said tubular portion, said strap provided with spaced openings substantially along its length, each for insertion of a charge therein, said strap dimensioned for snug-fitting insertion into said carrier;

a plurality of explosive charges each having an outer casing of a length substantially corresponding to the internal diameter of said tubular portion, said casing comprising a thin-walled casing half inserted through one of said openings and a thick-walled casing half abutting said strap in surrounding relation to a respective said opening, one end of said casing for each charge provided with an opening for insertion of said blasting cord therethrough, said strap and said charges arranged in mutually perpendicular relation to one another and disposed in close-fitting engagement to said inner wall surface of said tubular portion; and a blasting cord extending through said carrier and connected to said charges for detonation thereof, said strap and said carrier being composed of a material capable of being disintegrated upon detonation of said charges.

10. In perforating apparatus according to claim 9, each of said explosive charges having an outer resilient casing of a length substantially corresponding to the internal diameter of said tubular portion, one end of said casing for each charge provided with an opening for insertion of said blasting cord therethrough and an inner conical liner mounted in each charge.

11. In perforating apparatus according to claim 9, said opposite end caps being hermetically sealed at opposite ends of said tubular portion with rounded terminal end portions and leading ends of reduced diameter inserted into opposite ends of said tubular portion, and O-rings interpositioned between said leading ends of said end caps and opposite ends of said tubular portion, and said blasting cord extending through an opening in the upper end cap.

12. In perforating apparatus according to claim 9, said carrier being suspended from a wire line tool, said wire line tool including an elongated rod interconnecting said wire line tool at the upper end of said carrier, said rod including a lower threaded end insertable into an opening in the upper end cap of said carrier.

13. In perforating apparatus according to claim 9, said carrier being composed of a frangible material consisting of a major proportion by weight of a polystyrene and a minor proportion by weight of calcium carbonate.

* * * * *